US006921310B2

(12) United States Patent
Awaji et al.

(10) Patent No.: US 6,921,310 B2
(45) Date of Patent: Jul. 26, 2005

(54) GAS-DISCHARGE DISPLAY PANEL AND PROCESS FOR MANUFACTURING THE DISPLAY PANEL

(75) Inventors: Noriyuki Awaji, Kawasaki (JP); Shinji Tadaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 85 days.

(21) Appl. No.: 10/698,408

(22) Filed: Nov. 3, 2003

(65) Prior Publication Data

US 2004/0102126 A1 May 27, 2004

Related U.S. Application Data

(62) Division of application No. 09/553,745, filed on Apr. 20, 2000, now Pat. No. 6,674,236.

(30) Foreign Application Priority Data

May 20, 1999 (JP) ..... 11-139535

(51) Int. Cl.[7] ..... H01J 9/00

(52) U.S. Cl. ..... 445/24; 445/25; 65/33.1; 65/33.5; 65/33.6; 65/36; 428/426

(58) Field of Search ..... 313/582–587; 445/24, 25; 65/36, 17.3, 33.1, 33.5, 33.6; 428/426

(56) References Cited

U.S. PATENT DOCUMENTS

| | | | | |
|---|---|---|---|---|
| 4,741,963 A | | 5/1988 | Wada et al. | |
| 5,541,479 A | | 7/1996 | Nagakubo | |
| 5,838,106 A | | 11/1998 | Funada | |
| 5,948,537 A | * | 9/1999 | Onoda et al. | 428/426 |
| 5,952,782 A | | 9/1999 | Nanto et al. | |
| 5,985,460 A | * | 11/1999 | Wang et al. | 428/426 |
| 6,057,643 A | | 5/2000 | Kurai | |
| 6,333,116 B1 | * | 12/2001 | Laborde | 428/432 |
| 6,333,597 B1 | | 12/2001 | Mitomo | |
| 6,333,600 B1 | | 12/2001 | Mizobata | |
| 6,361,390 B1 | * | 3/2002 | Sreeram et al. | 445/24 |
| 6,512,330 B2 | | 1/2003 | Nakajima et al. | |
| 6,551,720 B2 | * | 4/2003 | Sreeram et al. | 65/36 |
| 6,582,826 B1 | | 6/2003 | Goto et al. | |

FOREIGN PATENT DOCUMENTS

| | | |
|---|---|---|
| JP | 03004428 A | 1/1991 |
| JP | 05290743 A | 11/1993 |
| JP | 6-338261 | 12/1994 |
| JP | 7-85797 | 3/1995 |
| JP | 9-129142 | 5/1997 |
| JP | 10-255666 | 9/1998 |
| JP | 2000016833 A | 1/2000 |

* cited by examiner

*Primary Examiner*—Mariceli Santiago
(74) *Attorney, Agent, or Firm*—Staas & Halsey LLP

(57) ABSTRACT

A display panel is provided that has a multilayer structure made of a colored glass layer having a desired shape and optical characteristics and a non-colored glass layer having high transparency, as well as high productivity. The display panel has a non-colored glass layer and a colored glass layer contacting the non-colored glass layer. A multilayer structure is formed that includes a colored paste layer and a non-colored paste layer. In the colored paste layer, crystallization glass powder that is crystallized at the temperature TA and coloring agent are diffused. In the non-colored paste layer, glass powder whose softening point is the temperature TB that is higher than the temperature TA. The multilayer structure is heated to the temperature TC that is higher than the temperature TB and is lower than the softening point of the crystallization glass powder after the crystallization to be burned, so that the non-colored glass layer and the colored glass layer are formed simultaneously.

7 Claims, 7 Drawing Sheets

GAS-DISCHARGE DISPLAY PANEL AND PROCESS FOR MANUFACTURING THE DISPLAY PANEL

This application is a divisional of application Ser. No. 09/553,745, filed Apr. 20, 2000, now U.S. Pat. No. 6,674, 236, issued Jan. 6, 2004.

BACKGROUND OF THE INVENTION

1. Field of the Invention

The present invention relates to a display panel having a multilayer structure including a colored glass layer and a non-colored glass layer and to a process for manufacturing the display panel.

The display panel utilizes a structure having a glass layer with a coloring agent disposed on the inner face of a substrate as a stripe-like or a grid-like light shield member for enhancing contrast or a filter for color reproduction.

2. Description of the Prior Art

An AC type gas discharge display panel (i.e., a plasma display panel) has a dielectric layer that insulates electrodes arranged on the inner surface of the substrate from the discharge space. In general, the dielectric layer is made of a low melting point glass and is spread over the whole screen uniformly. The colored glass layer of a predetermined color is overlayed by the dielectric layer (as an under coat, for example). Namely, a multilayer structure including a colored glass layer and a non-colored glass layer is formed on the substrate. A thick layer method is used for forming the multilayer structure, in which glass paste is coated and burned.

The dielectric layer is preferably burned at the temperature substantially higher than the softening point of the glass material. However, if it is burned at the temperature approximately 100 degrees centigrade higher than the softening point, flow of the glass may cause a pattern collapse of the colored glass layer, diffusion of the coloring agent into the dielectric layer resulting in deterioration of transparency of the dielectric layer, or color change of the coloring agent resulting failure in obtaining desired coloring effect. Therefore, conventionally, the composition of the glass material of the dielectric layer is selected so that the softening point becomes a relatively high temperature (e.g., 570 degrees centigrade), so that the burning is performed at a temperature (e.g, 590 degrees centigrade) that is near to the softening point. In addition, in order to obtain a good dielectric layer, a thin dielectric layer is formed on the colored glass layer using a glass material having high softening point, and then, a material having low softening point (e.g., 490 degrees centigrade) is used and is burned at substantially high temperature so that the dielectric layer having a necessary thickness can be formed. The thin dielectric layer can prevent the deformation of the colored glass layer and the diffusion of the coloring agent.

There is another problem if the electrode is made of a transparent conductive material (ITO, NESA). Namely, a metal oxide added as a coloring agent degenerates and causes the color change or fading of the colored glass layer. One of the methods to solve this problem is disclosed in Japanese unexamined patent publication No. 9-129142. The method includes the steps of providing a gap for preventing color change between the transparent electrode and the colored glass layer, and mixing an oxidation agent into the colored glass paste.

If the dielectric layer is formed by the method explained above in which the glass material is burned at the temperature that is close to the softening point, leveling and defoaming process in the softened state can be insufficient so that the surface layer becomes rough with many foams. This layer has little transparency and deteriorates the intensity. The method of coating the thick dielectric layer over the thin dielectric layer can improve the transparency but has a disadvantage in its low productivity since two burning steps are required. In addition, two materials are necessary for the dielectric layer.

Furthermore, in order to avoid the color change and the color fade, the method of providing the gap for preventing color change has a strict limitation for the arrangement pattern of the colored glass layer, while the method of adding the oxidation agent is limited to a special coloring agent.

SUMMARY OF THE INVENTION

The object of the present invention is to provide a display panel that has a multilayer structure including a colored glass layer with a predetermined shape and optical characteristics and a non-colored glass layer with a high transparency, and is superior in productivity.

In the present invention, a crystallization glass that can be crystallized in the temperature lower than the softening point of the non-colored glass material is used as a material of the colored glass layer. The shape of the colored glass layer can be maintained even if the non-colored glass material is softened by crystallization. In addition, since the coloring agent is closed in the crystal, it is not diffused into the non-colored glass layer, and chemical change is hard to occur due to the heat. Therefore, the colored glass layer and the non-colored glass layer can be burned simultaneously for improving the productivity.

According to a first aspect of the present invention, a gas discharge display panel is provided that has a structure including transparent electrodes arranged on the inner surface of one of substrates and a non-colored glass layer between a discharge space and the transparent electrodes. The display panel has a colored glass layer that includes crystallization glass containing coloring agent and contacts the non-colored glass layer.

According to a second aspect of the present invention, the colored glass layer contacts both the transparent electrode and the non-colored glass layer.

According to a third aspect of the present invention, the colored glass layer is a light shielding layer containing the coloring agent selected from the group of iron monoxide (FeO), dichrome trioxide ($Cr_2O_3$), copper monoxide (CuO), nickel oxide ($Ni_2O_3$), cobalt oxide (CoO) and manganese dioxide ($MnO_2$).

According to a fourth aspect of the present invention, the colored glass layer is a reflecting layer containing the coloring agent selected from the group of titanium dioxide ($TiO_2$), aluminum oxide ($Al_2O_3$), silicon dioxide ($SiO_2$), barium sulfate ($BaSO_4$), barium titanate ($Ba_2TiO_3$), and mica isinglass.

According to a fifth aspect of the present invention, the colored glass layer is a filtering layer containing the coloring agent selected from the group of chromium oxide and cobalt oxide.

According to a sixth aspect of the present invention, a process for manufacturing a display panel is provided, which has a non-colored glass layer and a colored glass layer that contacts the non-colored glass layer. The process includes the step of forming a multilayer structure that includes a colored paste layer and a non-colored paste layer. In the colored paste layer, crystallization glass that is crystallized at the temperature TA and coloring agent are diffused. In the non-colored paste layer, glass powder having softening point that is the temperature TB higher than the temperature TA is diffused. The process also includes the step of heating and burning the multilayer structure to the temperature TC that is higher than the temperature TB and is lower then the softening point of the crystallization glass powder after the crystallization, so as to form the non-colored glass layer and colored glass layer simultaneously.

According to a seventh aspect of the present invention, the heating and burning step of the multilayer structure includes the step of setting the temperature gradient of the crystallization temperature range from the temperature lower than the temperature TA to the temperature TA smaller than the temperature gradient of the temperature range from the temperature TB to the temperature TC.

According to an eighth aspect of the present invention, the temperature difference between the temperature TB and the temperature TC is set to a value more than 50 degrees centigrade.

According to a ninth aspect of the present invention, the crystallization glass powder has a softening point that is higher than the temperature TB after the crystallization by 100 degrees centigrade or more.

DESCRIPTION OF THE PREFERRED EMBODIMENTS

Figure 1:
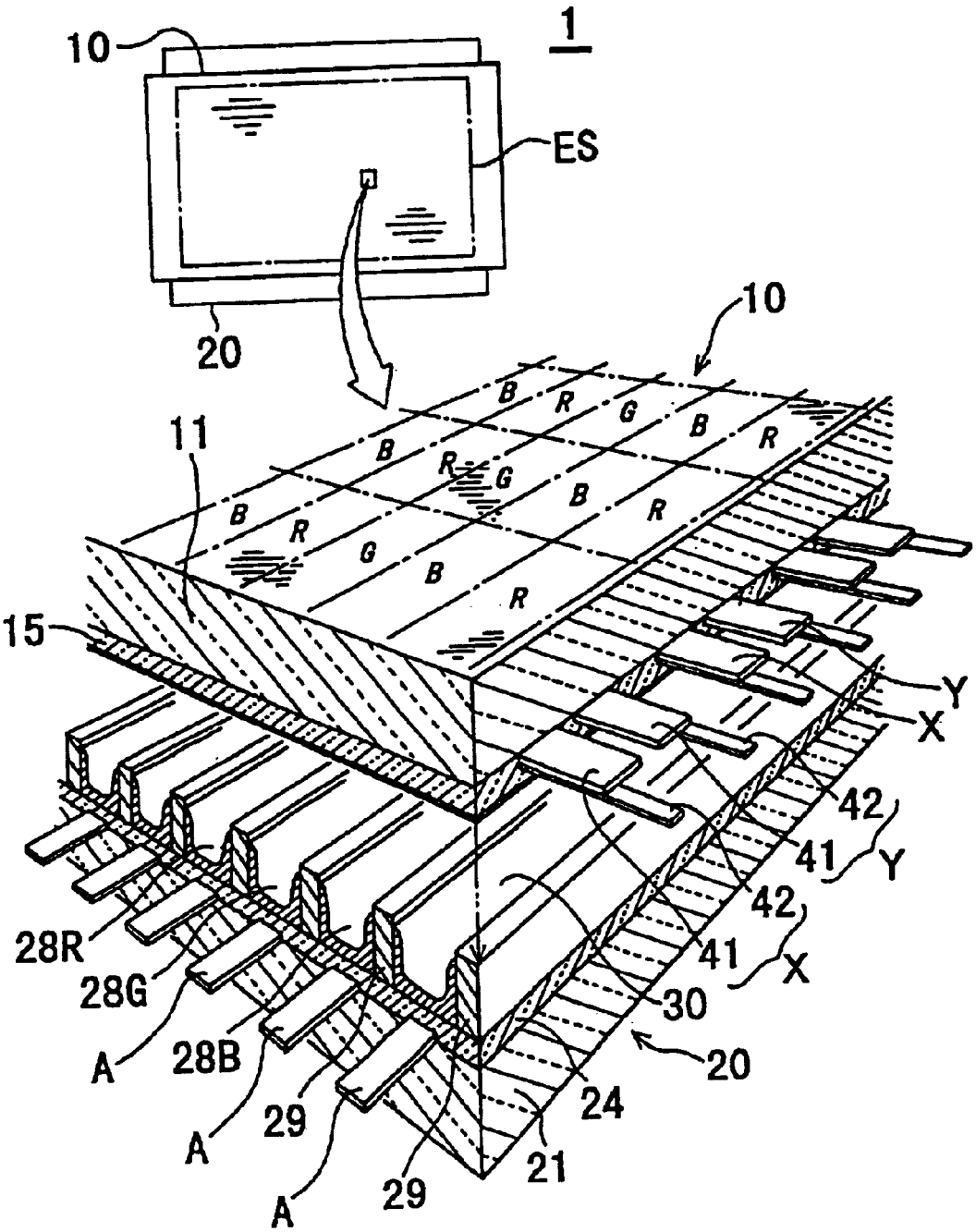
FIG. 1 is a perspective view showing the inner structure of the plasma display panel according to the present invention.

FIG. 1 is a perspective view showing the inner structure of the plasma display panel according to the present invention. In this figure, a pair of substratal structures is drawn in an exploded, or separated, perspective view for easy viewing of the structure. However, they are contracted with each other in actual use. The substratal structure means a structure including a plate-like support whose size is larger than the screen and at least another panel constituting member.

The plasma display panel 1 has a three-electrode surface discharge structure including a first and a second main electrodes X, Y arranged in parallel that make an electrode pair for generating sustaining discharge, and an address electrode A as a third electrode that crosses the main electrodes X, Y in each cell (a display element). The main electrodes X, Y extend in the row direction (the horizontal direction) of the screen, and the second main electrode Y is used as a scanning electrode for selecting cells in a row for address. The address electrode A extends in the column direction (the vertical direction) and is used as a data electrode for selecting cells in a column. The area of the substrate surface where the main electrodes and the address electrodes cross each other corresponds to the screen ES.

In the plasma display panel 1, a pair of main electrodes X, Y is arranged for each row on the inner surface of the glass substrate 11 of the front side substratal structure 10. The row includes cells aligned in the horizontal direction in the screen. Each of the main electrodes X, Y includes a transparent conductive film (an ITO thin film) 41 and a metal thin film (Cr/Cu/Cr) 42 as a bus conductor, both of which are covered with an insulation layer 15 that has a multilayer structure as explained below. The address electrode A is arranged on the inner surface of the glass substrate 21 of the backside substratal structure 20, and is covered with an insulation layer 24 having thickness of approximately 10 $\mu$m. A partition 29 having a shape of linear ribbon as a plan view and height of 150 $\mu$m is provided on the insulation layer 24 between the address electrodes A. These partitions 29 define the discharge space 30 for each subpixel (unit area of lighting) in the row direction and determine the gap size of the discharge space 30. Covering the backside inner surface including the upper portion of the address electrode A and the side face of the partition 29, red fluorescent material 28R, green fluorescent material 28G and blue fluorescent material 28B are arranged in the row direction in a periodical pattern of three colors.

The discharge space 30 is filled with a discharge gas including a main component of neon and 4–5% of xenon. The fluorescent material 28R, 28G and 28B are pumped locally to emit light by ultraviolet rays emitted by xenon upon discharge. A pixel of the display includes three subpixels having different light colors arranged in the row direction. The structure of each subpixel is the cell. Since the arrangement pattern of the partition 29 is a stripe pattern, the portion of the discharge space 30 corresponding to each column is continuous over the all rows in the column direction. The electrode gap called an inverse slit between the neighboring rows is substantially larger than the surface discharge gap (e.g., a value within the range of 80–140 $\mu$m), and is set to a value that can prevent the discharge connection in the column direction (e.g., a value within the range of 400–500 $\mu$m). After generating the address discharge between the main electrode Y and the address electrode A in the cell that is to be lightened (in the write address format) or the cell that is not to be lightened (in the erase address format) so that the charged state of appropriate wall charge only in the cell that is to be lightened is formed for each line, the sustaining voltage Vs is applied between the main electrodes X, Y. Thus, the surface discharge can be generated along the substrate surface in the cell that is to be lightened. The above-explained plasma display panel 1 is manufactured by the process of combining the front side substratal structure 10 with the backside substratal structure 20 that was manufactured in the other process and seaming the peripheral portion of the structures 10 and 20.

Figure 2:
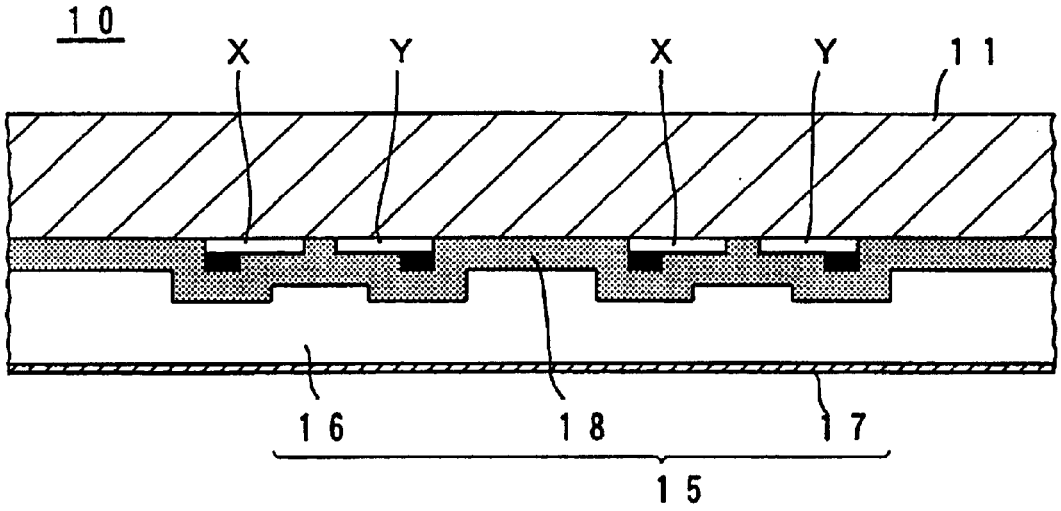
FIG. 2 is a cross section of the principal portion of one substratal structure.
Figure 3:
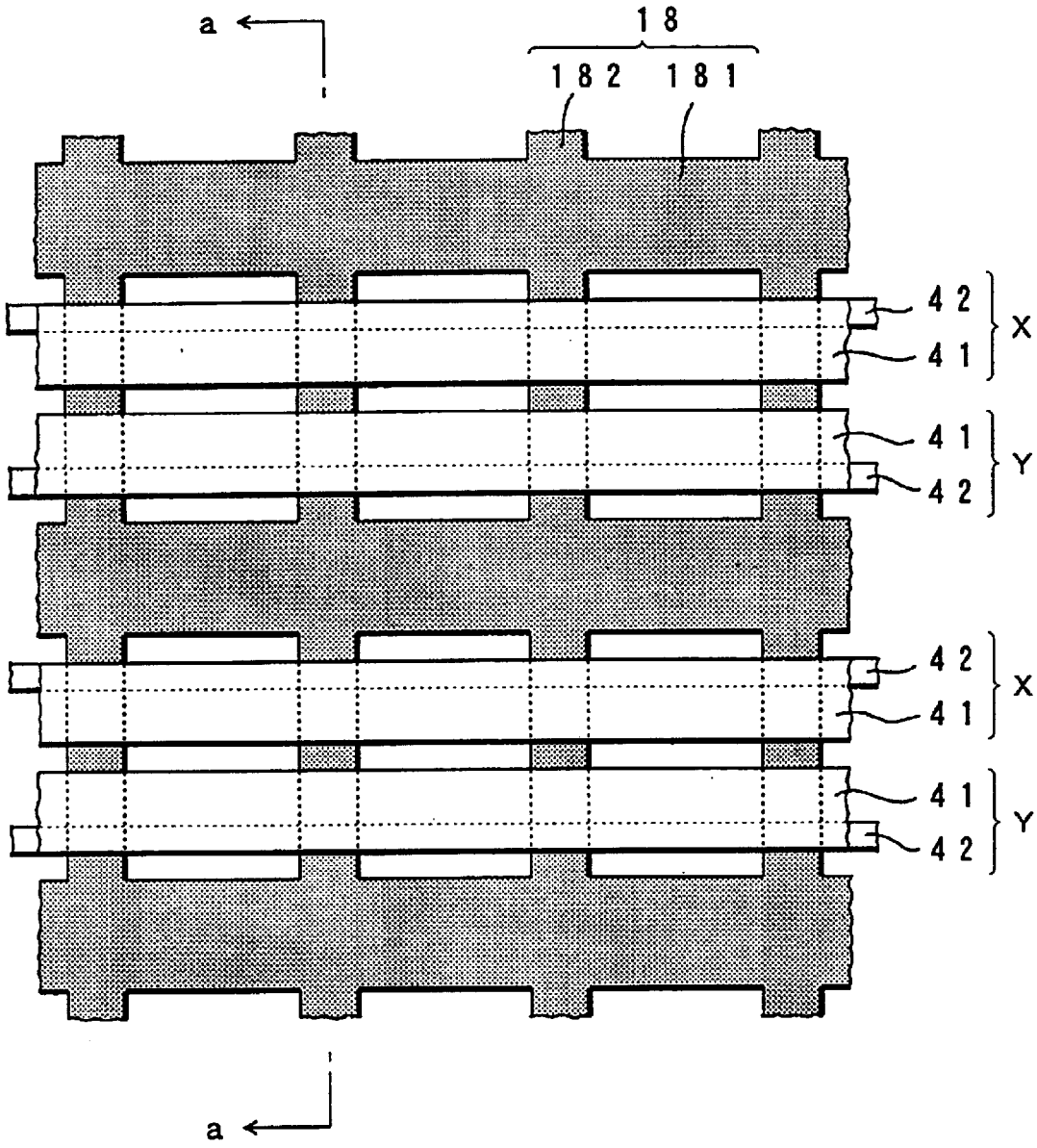
FIG. 3 is a plan view showing the shape of the colored glass layer.

FIG. 2 is a cross section of the principal portion of one substratal structure. FIG. 3 is a plan view showing the shape of the colored glass layer. FIG. 2 corresponds to the a—a cross section of FIG. 3.

As shown in FIG. 2, the insulation layer 15 is a multilayer structure including a dark colored glass layer 18 made of a crystallization glass, a non-colored dielectric layer 16 made of a low melting point glass and a protection film 17 having thickness of a few thousands angstrom made of magnesia (MgO). The colored glass layer 18 is the under layer of the dielectric layer 16 and has thickness of approximately 2–5 $\mu$m. The dielectric layer 16 has thickness of approximately 30 $\mu$m.

As shown in FIG. 3, the colored glass layer 18 is a grid-like light shielding member (this is called a black matrix) including a portion 181 extending in the row direction in the inverse slit and a potion 182 extending in the column direction in the boundary of rows. The portion 182 extending in the column direction is overlayed on the main electrodes X, Y and abuts the transparent conductive film 41. Though the portion 181 extending in the row direction is separated from the main electrodes X, Y in the figure, it can be overlayed on the main electrodes X, Y without being off the edge of the metal film 42 in the surface discharge gap side. In addition, the shape of the colored glass layer 18 in the plan view is not limited to the grid-like shape but can be a stripe shape made of the portion (a black belt) 181 extending in the row direction.

Figure 4A:
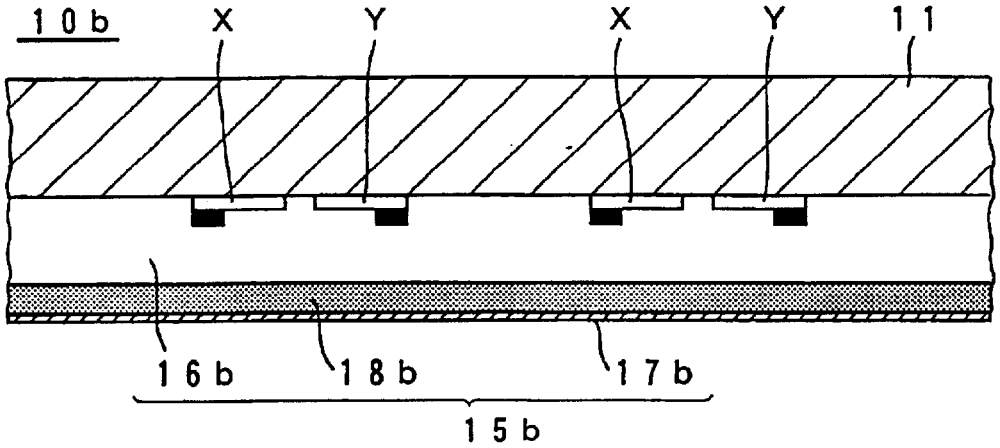
FIGS. 4A–4C are cross sections showing a variation of the multilayer structure of the substratal structure.
Figure 4B:
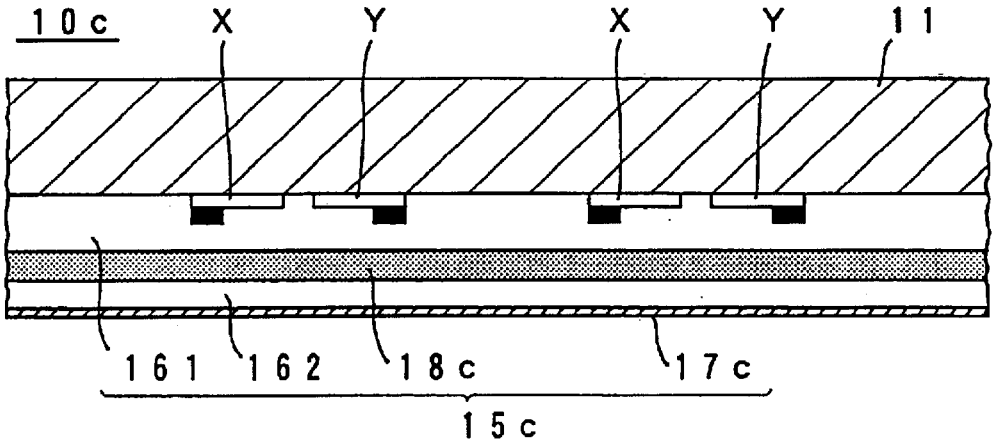
Figure 4C:
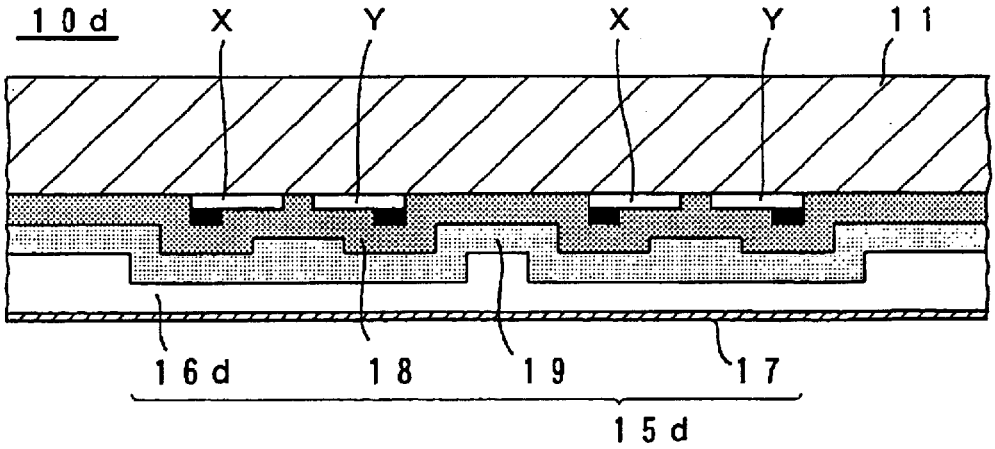

FIGS. 4A–4C are cross sections showing a variation of the multilayer structure of the substratal structure.

FIG. 4A shows the substratal structure 10*b*, in which the insulation layer 15*b* includes the dielectric layer 16*b* overlayed by the colored glass layer 18*b*, and the protection film 17*b* is formed on the surface of the colored glass layer 18*b*.

FIG. 4B shows the substratal structure 10*c*, in which the insulation layer 15*c* includes the first dielectric layer 161 overlayed by the colored glass layer 18*c*, which is covered with the second dielectric layer 162 and the protection film 17*c*.

FIG. 4C shows the substratal structure 10*d*, in which the insulation layer 15*d* includes the colored glass layer 18 as the light shielding layer, the bright colored glass layer 19 as the reflecting layer, the dielectric layer 16*d* and the protection film 17. Providing the colored glass layer 19, light from the discharge space to the colored glass layer 18 can be used for displaying light.

Hereinafter, the process of manufacturing the plasma display panel 1 will be explained with reference to FIG. 2 as the example of the multilayer structure.

Figure 5A:
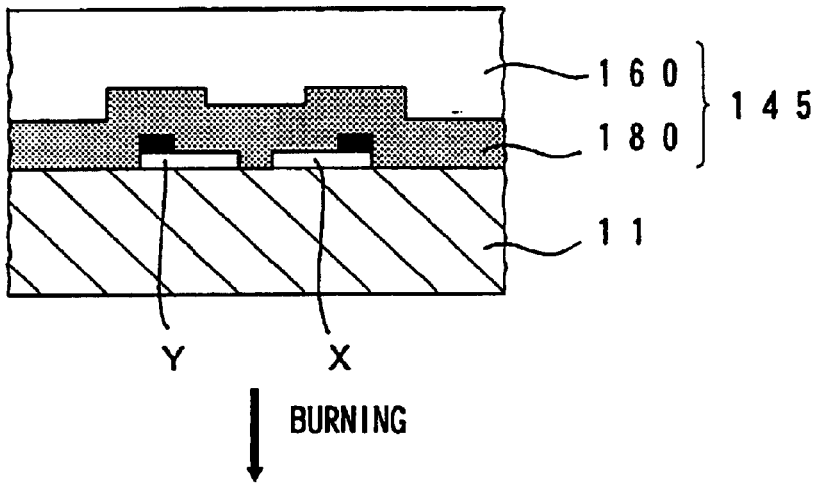
FIGS. 5A–5C are cross sections of the principal portion of the substratal structure in the process.
Figure 5B:
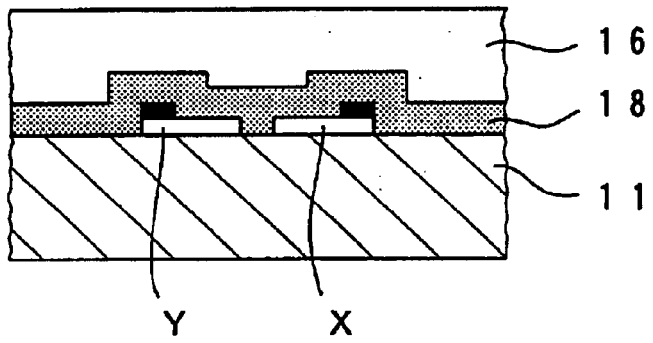
Figure 5C:
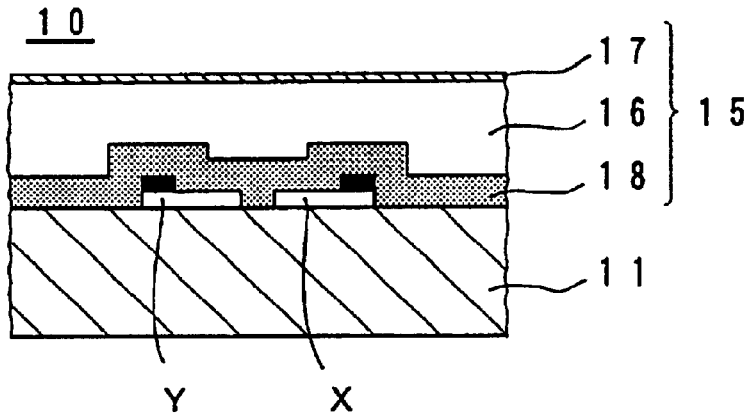

FIGS. 5A–5C are cross sections of the principal portion of the substratal structure in the process, which illustrates the process of forming the insulation layer 15.

In the manufacturing process of the front side substratal structure 10 explained above, after arranging the main electrodes X, Y on the glass substrate 11, photosensitive glass paste is coated thereon that includes crystallization glass as a main component and dark color pigments. The coat layer is patterned by photolithography process so as to make the colored paste layer 180 like a grid in the plan view. The, the low melting point glass paste without a coloring agent is coated as a non-colored paste layer 160 on the colored paste layer 180. Thus, the multilayer structure 145 made of the colored paste layer 180 and the non-colored paste layer 160 is formed on the glass substrate 11 as shown in FIG. 5A. The glass material is selected so that the softening point of the low melting point glass is set to relatively low temperature (e.g., 500 degrees centigrade). Then a crystallization glass is used that is crystallized at the temperature lower than the softening point of the low melting point glass.

The multilayer structure 145 is heated from the room temperature to the temperature (eg., 590 degrees centigrade) that is substantially higher than the softening point of the low melting point glass for burning in appropriate temperature gradient, so that the colored glass layer 18 and the dielectric layer 16 are formed simultaneously as shown in FIG. 5B. Since the difference between the softening point and the burning temperature is enlarged, defoaming and leveling of the surface are performed sufficiently, so that the dielectric layer 16 with high transparency can be obtained. In addition, since the colored paste layer 180 is crystallized and its viscosity is increased before the low melting point glass is softened, the pattern collapse of the colored paste layer 180 does not occur even if the viscosity of the low melting point glass is lower to approximately $10^3$ PS after being heated to a sufficiently high temperature. In addition, the pigments do not diffuse into the non-colored paste layer 160, and the coloring of the dielectric layer 18 can be prevented.

After forming the colored glass layer 18 and the dielectric layer 16 in this way, magnesia is deposited on the surface of the dielectric layer 18 by vapor deposition so as to form the protection film 17. Thus, the substratal structure 10 is completed as shown in FIG. 5C.

An example of the composition of the crystallization glass is shown in Table 1, and the composition of the colored glass paste is shown in Table 2.

TABLE 1

| GLASS COMPONENT | CONTENT |
|---|---|
| PbO | 72–77 wt % |
| $B_2O_3$ | 5–10 wt % |
| $SiO_2$ | 1–6 wt % |
| ZnO | 10–15 wt % |
| BaO | 1–6 wt % |

TABLE 2

| PASTE COMPONENT | CONTENT |
|---|---|
| crystallization glass | 23 wt % |
| pigment (iron monoxide) | 40 wt % |
| "vehicle" (resin and solvent) | 37 wt % |

The mixing ratio of the colored glass paste in "vehicle" is set to 5 wt% for resin and 95 wt% for solvent. Concerning the pigment, dichrome trioxide, copper monoxide, nickel oxide, cobalt oxide, manganese dioxide or mixture thereof can be used replacing or adding to iron monoxide.

Figure 6:
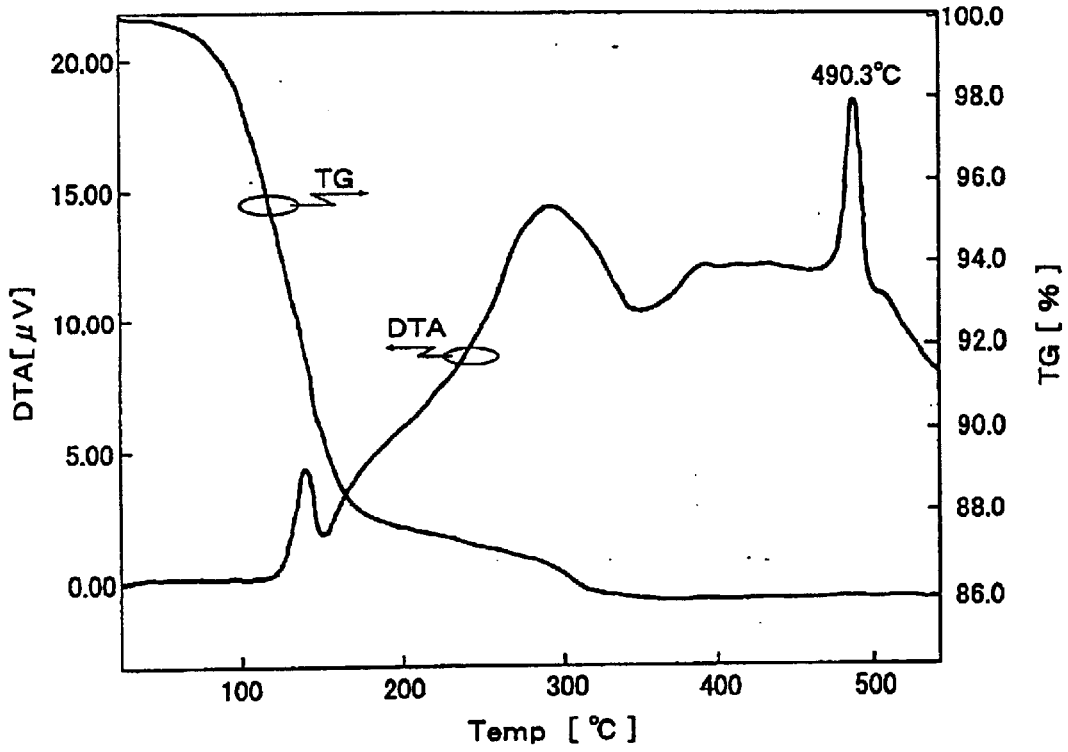
FIG. 6 is a graph showing the measurement result of the crystallization peak temperature by the differential thermogravimetric analysis.

FIG. 6 is a graph showing the measurement result of the crystallization peak temperature by the differential thermogravimetric analysis.

As shown by the DTA curve in FIG. 6, the solvent evaporates at the temperature of approximately 139 degrees centigrade and the resin is burned out at temperature of approximately 294 degrees centigrade in the colored glass paste having the composition shown in Table 1 and Table 2. Then, crystallization occurs at the temperature of approximately 490 degrees centigrade. The crystallization peak temperature is 490.3 degrees centigrade that is lower than the softening point (500 degrees centigrade) of the low melting point glass that is a dielectric material.

Figure 7:
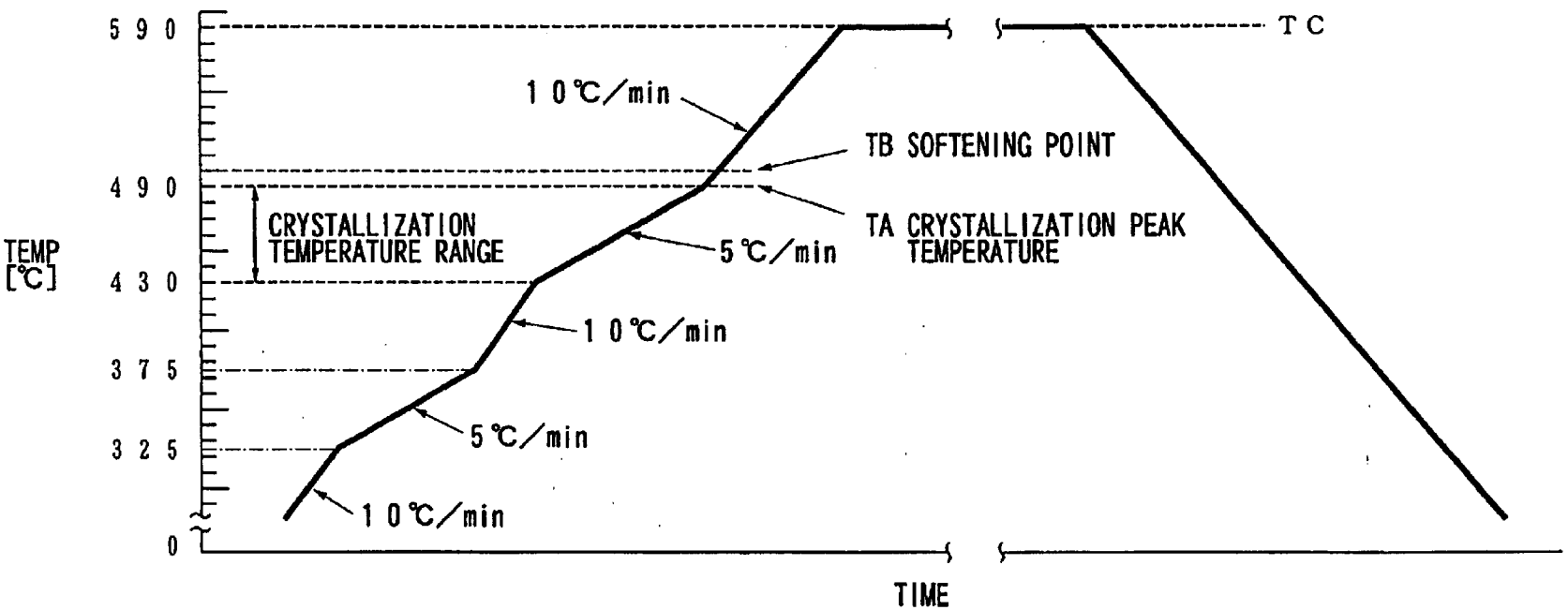
FIG. 7 shows an example of burning profile.

FIG. 7 shows an example of burning profile.

In the process of burning from the room temperature to the temperature TC sufficiently higher than the softening point TB of the low melting point glass, the temperature gradient is 5 degrees centigrade/min in the crystallization temperature range from a predetermined temperature (430 degrees centigrade in the figure) lower than the crystallization peak temperature TA to the crystallization peak temperature TA. This temperature gradient is smaller than the temperature gradient (10 degrees centigrade/min) in the temperature range from the softening point TB to the temperature TC. The crystallization can be in progress by keeping the temperature that is close to the crystallization peak temperature TA for long period even if the temperature is lower than the crystallization peak temperature TA. A good crystallization state can be obtained by reducing the temperature gradient. After the crystallization, the ratio of increasing temperature can be accelerated within the range that is not excessive so as to increase the productivity. The time period for keeping the temperature TC for promoting sufficient defoaming and leveling is 60 min, for example. Since the temperature difference between the softening point TB and the temperature TC is 90 degrees centigrade, the crystallization glass can be selected from one whose softening point after the crystallization is higher by 100 degrees centigrade than the softening point TB of the low melting point glass.

A dielectric layer (a non-colored glass layer) having large transparency compared with the conventional one and a colored glass layer 18 having a predetermined color without pattern collapse were obtained by burning in the profile shown in FIG. 7.

In the above-explained embodiment, a reflection type surface discharge plasma display panel is illustrated, in which the fluorescent material is arranged on the backside substrate. However, the present invention can be applied to a transparent type in which the fluorescent material is arranged on the front side substrate. In the transparent type, the address electrode A is a transparent electrode and the insulation layer 24 covering the address electrode A is a multilayer structure including a colored glass and a non-colored glass.

According to the present invention, a display panel is provided which has a multilayer structure including a colored glass layer having desired shape and optical characteristics and a non-colored glass layer having high transparency. In addition, the display panel has a good productivity.

According to another configuration of the present invention, the productivity of the display panel can be improved, which has a multilayer structure including a colored glass layer having desired shape and optical characteristics and a non-colored glass layer having high transparency.

What is claimed is:

1. A process for manufacturing a display panel having a noncolored glass layer and a colored glass layer that contacts the non-colored glass layer, the process comprising:

forming a multilayer structure comprising a colored paste layer, in which crystallization glass that is crystallized at a temperature TA and a coloring agent are diffused, and a non-colored paste layer in which a glass powder has a softening point temperature TB, higher than the temperature TA; and heating and burning the multilayer structure to a temperature TC, higher than the temperature TB and lower than the softening point of the crystallization glass powder after crystallization thereof, so as to form the non-colored glass layer and the colored glass layer simultaneously.

2. The process according to claim 1, wherein the heating and burning of multilayer structure further comprises setting a temperature gradient of a crystallization temperature range from a temperature lower than the temperature TA to the temperature TA, smaller than a temperature gradient of the temperature range from the temperature TB to the temperature TC.

3. The process according to claim 1, wherein a temperature difference between the temperature TB and the temperature TC is set to a value greater than 50 degrees Centigrade.

4. The process according to claim 1, wherein the crystallization glass powder has a softening point, after crystallization, that is higher than the temperature TB by 100 degrees Centigrade or more.

5. The process for manufacturing a display panel according to claim 1, wherein the colored glass layer is a light shielding layer and the coloring agent is selected from the group consisting of iron monoxide, dichrome trioxide, copper monoxide, nickel oxide, cobalt oxide and manganese dioxide.

6. The process for manufacturing a display panel according to claim 1, wherein the colored glass layer is a reflecting layer and the coloring agent is selected from the group consisting of titanium dioxide, aluminum oxide, silicon dioxide, barium sulfate, barium titanate, and mica isinglass.

7. The process for manufacturing a display panel according to claim 1, wherein the colored glass layer is a filtering layer and the coloring agent is selected from the group consisting of chromium oxide and cobalt oxide.

* * * * *